US009783342B2

(12) United States Patent
Elder

(10) Patent No.: US 9,783,342 B2
(45) Date of Patent: Oct. 10, 2017

(54) BOTTLE CLOSURE HAVING A HOLLOW STRUCTURE

(71) Applicant: Jack E. Elder, Oakland Township, MI (US)

(72) Inventor: Jack E. Elder, Oakland Township, MI (US)

(73) Assignee: Multiject LLC, Rochester, MI (US)

( * ) Notice: Subject to any disclaimer, the term of this patent is extended or adjusted under 35 U.S.C. 154(b) by 153 days.

(21) Appl. No.: 14/188,626

(22) Filed: Feb. 24, 2014

(65) Prior Publication Data

US 2015/0239620 A1 Aug. 27, 2015

(51) Int. Cl.

| | |
|---|---|
| ***B65D 39/04*** | (2006.01) |
| ***B65D 39/16*** | (2006.01) |
| ***B65D 39/00*** | (2006.01) |

(52) U.S. Cl.

CPC ..... *B65D 39/04* (2013.01); *B65D 39/0023* (2013.01); *B65D 39/16* (2013.01); *B65D 2539/005* (2013.01); *B65D 2539/008* (2013.01)

(58) Field of Classification Search

CPC .... B65D 39/0023; B65D 39/16; B65D 39/04; B65D 2539/005; B65D 2539/008

USPC ..... 215/355, 364

See application file for complete search history.

(56) References Cited

U.S. PATENT DOCUMENTS

| | | | | |
|---|---|---|---|---|
| 2,641,375 A * | 6/1953 | Steuart | B65D 39/16 | 215/364 |
| 4,363,416 A * | 12/1982 | Loughmiller | B65D 39/0064 | 215/364 |
| 2004/0004053 A1* | 1/2004 | Zurcher | B65D 39/007 | 215/364 |
| 2015/0060390 A1* | 3/2015 | Elder | B65D 39/16 | 215/364 |

* cited by examiner

*Primary Examiner* — James N Smalley

(74) *Attorney, Agent, or Firm* — Maginot, Moore & Beck LLP

(57) ABSTRACT

A bottle closure includes a closure element and a cap element. The closure element is configured to be received at least in part within a portion of a bottle. The closure element includes a first portion of a first material and a second portion of a second material. The second material has a lower durometer hardness than the first material. The second material is moldably bonded to the first material. The closure element defines a hollow interior. The cap element is coupled to the closure element.

19 Claims, 5 Drawing Sheets

SECTION E-E

SECTION E-E

BOTTLE CLOSURE HAVING A HOLLOW STRUCTURE

FIELD OF THE INVENTION

The present invention relates generally to bottle closures, and in particular, to reusable bottle closures.

BACKGROUND OF THE INVENTION

Bottle closures for alcoholic liquids, for example, wine, have historically been crafted of cork material. Cork is made from bark of certain trees, for example, the Cork Oak. Cork has qualities particularly suited to storing wine such as impermeability and a certain level of compressibility that allows for both a tight closure and removability. In contrast to bark, wood fibers do not have sufficient compressibility.

Due to extensive use, however, cork supplies are limited, thereby driving up price. Moreover, cork closures carry with them the risk of a taint that can be passed onto the wine. It has been estimated that as much as seven percent of wine bottles have some level of "corking", or taint imparted by the cork.

Cork also has strength issues in applications using attached caps, where the cork is glued or otherwise fastened to the polymer, metal or wood top. Breakage rates are as high as 10% at some end users and the retail marketplace.

As a consequence, the beverage industry has sought other materials and structures for bottle closures. Metal "screw top caps" have been used with some success. Metal screw tops are formed of a metal skirt and plastic sealing layer. Screw tops extend over the outside of the bottle, as opposed to corks that are inserted into the bottle neck. While screw top caps are not susceptible to taint, screw top caps are sometimes questioned for their suitability for long term aging, and are unfavorably received by many consumers in this market. Moreover, screw top caps can lack aesthetic qualities associate with softer materials.

In other cases, it has been found that certain polymers can be used for wine bottle closures that behave in a manner more similar to cork. Polymer closures can have similar compressibility. However, polymer closures similarly suffer from a lack of aesthetics associated with fine wine. Polymer closures are also given to "creep", which deforms the closure over time and can lead to failure.

Some attempts have been made to combine certain materials with the polymer closure to take advantage of the mechanical properties of the polymer while improving the aesthetics. In one example, a closure includes a plastic, wood or metal head portion glued to a thermoplastic polymer portion. The thermoplastic polymer portion inserts into the bottle, while the head remains outside the bottle and provides a gripping portion for extraction. The drawback of this design is that the glue joints often fail, causing separation of the polymer sealing material from the head.

Another common embodiment in this line of products is to mold a synthetic polymer shank over the top of another compatible polymer, such as polypropylene, where the two materials form a very strong cohesive bond. In this embodiment, the polymer shank material forms a very thick section to simulate natural cork and provide the necessary cushioning and tolerance zone in order to fit the variety of bottle necks found in the market. This type of closure construction is inefficient in its use of material and often results in voids, inclusions, size variations and other quality issues due to the thickness and volume of the molded material. This type of closure also is expensive to produce as the manufacturing cycle is relatively long and the volume of material required is large.

What is needed is a bottle closure that has sealing qualities comparable to cork, while having a versatile aesthetic human interface, and offering lower cost of manufacture.

SUMMARY OF THE INVENTION

The present invention addresses the above state need, as well as others, by providing a bottle closure having a hollow engineered structure and a method of attaching various types and sizes of caps to the mechanically functional base closure. Such a bottle closure is particularly well-suited to, but is not limited to, glass bottles used in the wine, spirits, olive oil and syrup industries.

In a first embodiment, a bottle closure includes a closure element and a cap element. The closure element is configured to be received at least in part within a portion of a bottle. The closure element includes a first portion of a first material and a second portion of a second material. The second material has a lower durometer hardness than the first material. The second material is moldably bonded to the first material. The closure element defines a hollow interior. The cap element is coupled to the closure element.

In a second embodiment, a bottle closure similarly includes a closure element and a cap element. The closure element is configured to be received at least in part within a portion of a bottle. The closure element comprising a cup structure defining a hollow interior. The cup structure comprises a first material and a second material, the second material having a lower durometer hardness than the first material. The second material is moldably bonded to the first material. The cap element is coupled to the closure element.

In some embodiments, the cap element is snap fit over the closure element, such that different variants of cap elements may be assembled onto uniformly made closure elements.

The above-described features and advantages, as well as others, will become more readily apparent to those of ordinary skill in the art by reference to the following detailed description and accompanying drawings.

DETAILED DESCRIPTION

Figure 1:
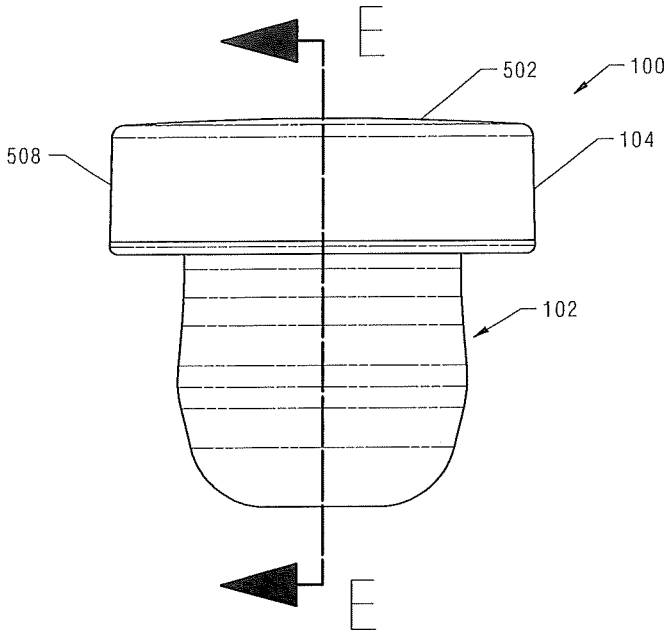
FIG. 1 shows front plan view of a bottle closure according to at least one embodiment of the invention.
Figure 2:
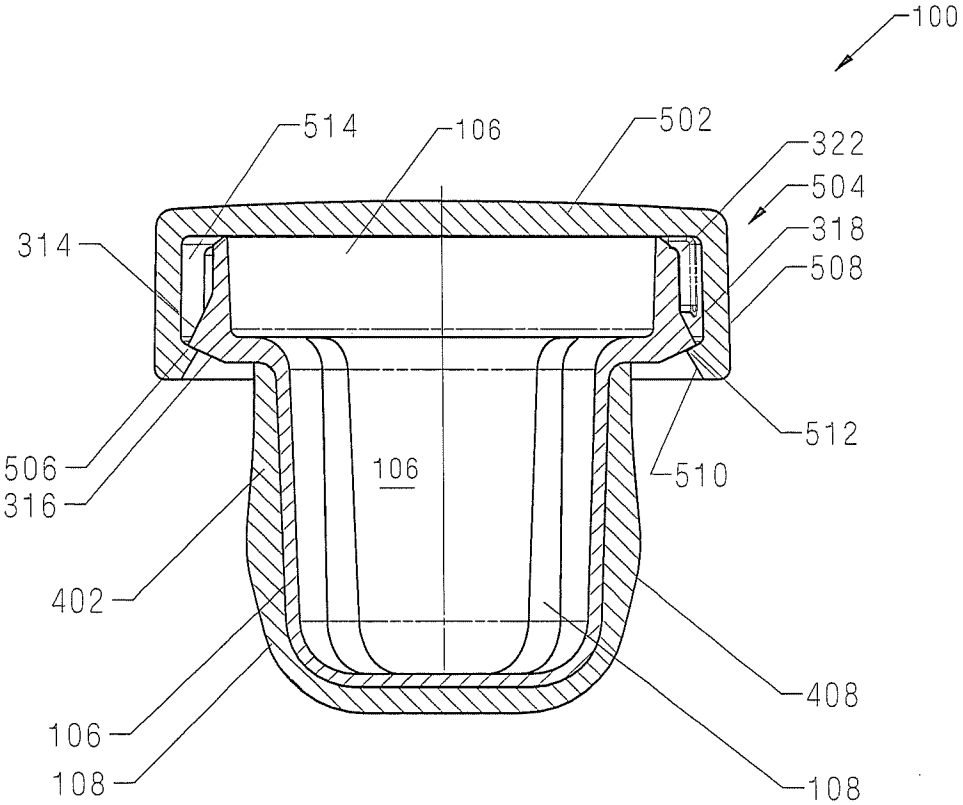
FIG. 2 shows a side cutaway view of the bottle closure of FIG. 1.

Reference is made to FIGS. 1 and 2 of the drawings. FIG. 1 shows a front plan view of a bottle closure 100 according to at least one embodiment of the invention. FIG. 2 shows a cutaway view of the bottle closure 100. The bottle closure 100 includes a closure element 102 and a cap element 104. The closure element 102 is configured to be received at least in part within a portion of a bottle, for example, the neck of a conventional wine bottle, spirits bottle, olive oil bottle, or similar bottle, not shown. The cap element 104 is affixed to the closure element 102 and is designed to rest above the bottle opening to allow the user to grasp and remove the bottle closure 100.

In this embodiment, the closure element 102 includes a first portion 106 constructed of a first material and a second portion 108 of a second material, the second material having a lower durometer hardness than the first material. The second material is moldably bonded to the first material, such that the first portion 106 and second portion 108 collectively form the closure element 102. Preferably, the closure element 102 defines a hollow interior, as shown in FIG. 2.

Figure 3A:
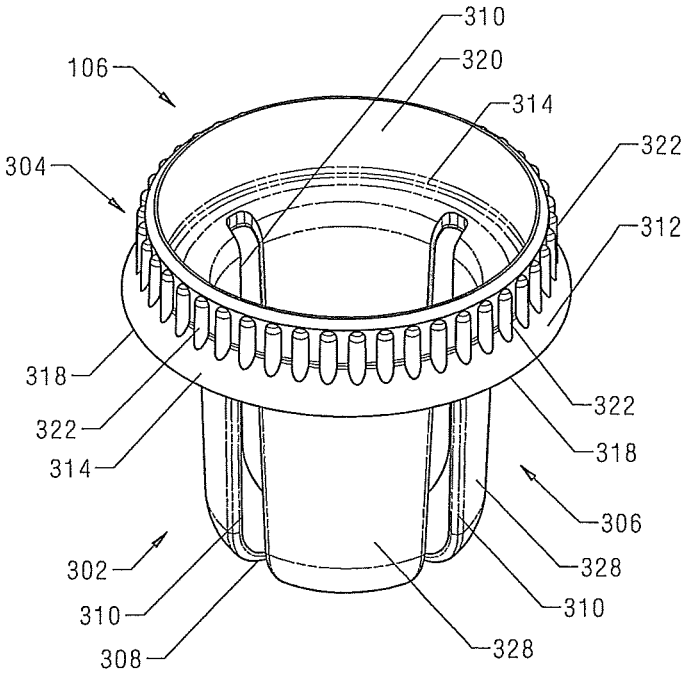
FIGS. 3*a*-3*b* show different perspective views of a first portion of the closure element of the bottle closure of FIG. 1.
Figure 3B:
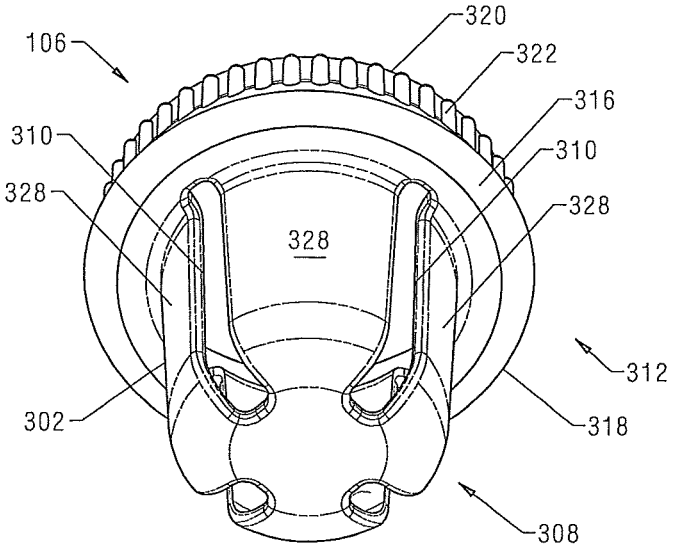

FIGS. 3*a* and 3*b* show in further detail different perspective views of the first portion 106 of the closure element 102 of the bottle closure 100 of FIG. 1. FIG. 3*a* shows a top perspective view of the first portion 106, and FIG. 3*b* shows a bottom perspective view of the first portion 106. With simultaneous reference to FIGS. 3*a* and 3*b*, the first portion 106 of the closure element 102 comprises a fragmented cup structure 302 and a head portion 304. The fragmented cup structure 302 has a generally rounded side 306, a bottom structure 308, and an open top. The rounded side 306 including a plurality of axial slots 310 formed therein. The axial slots 310 extend partially into the bottom structure 308.

As shown in FIG. 3*a*, the rounded side 306 essentially defines a broken or fragmented cylinder or cup. Although substantially cylindrical, the rounded side 306 has a slight taper, thereby making the rounded side 306 slightly frusto-conical in shape. However, it will be appreciated that the overall shape is largely cylindrical.

The head portion 304 includes a shelf 312 extending radially outward of the top of the fragmented cup structure 302. The shelf 312 includes an upper surface 314 (see FIG. 3*a*) and a lower surface 316 (see FIG. 3*b*). The upper surface 314 and lower surface 316 both taper toward each other such that they meet at their radially outward extent, thereby defining the outer edge 318 of the shelf 312. The outer edge 318 and tapering of the surfaces 314 and 316 create a structure for snap-fitting and retaining the cap element 102 as will be discussed further below.

The rounded side 306 and a part of the bottom structure 308 of the fragmented cup structure 302 define a plurality of spring elements 328 separated by the axial slots 310. The spring elements 328 are normally biased into the shape of the fragmented cup structure 302. However, the spring elements 328 can flex inward to allow the closure element 102 to be inserted into the bottle neck. As will be discussed below, when the closure element 102 is within the bottle, the bias of the spring elements 328 helps create a better seal. Preferably the axial slots 310 continue at least partly into the bottom structure 308 and at least partly into the annular shelf 312, providing for more flex points. However, it will be appreciated that the slots 310 may take other shapes and nevertheless provide at least some flexibility to the spring elements 328. For example, the slots 310 may extend annularly instead of axially, or a combination of both. The slots 310 may or may not extend into either the annular shelf 312 or the bottom structure 310. Nevertheless, the design of the slots 310 in the present embodiment is particularly advantageous in providing the desired spring action.

The head portion 304 of the first portion 106 of the closure element 102 further includes an annular ridge 320 extending axially upward from the upper surface 314 of the shelf 312. The ridge 320 in this embodiment is cylindrical, and includes a plurality of detents 322 disposed on an outer surface thereof. As will be discussed further below, the ridge 320 and the detents 322 help support and retain the cap element 104.

Figure 4A:
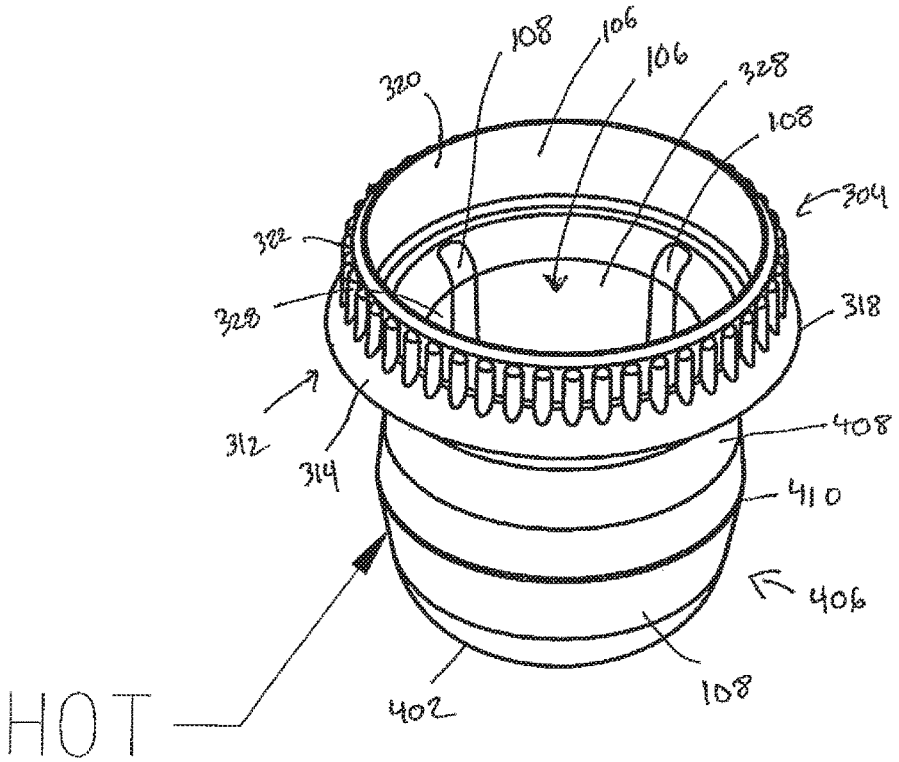
FIGS. 4*a*-4*b* show different perspective views of the closure element of the bottle closure of FIG. 1.
Figure 4B:
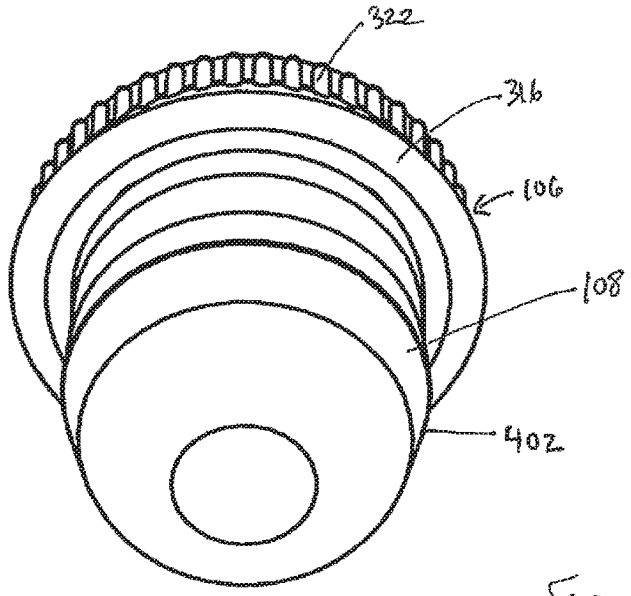

As discussed above, the closure element 102 further includes a second portion 108 bonded to the first portion 106 using a two-shot injection molding process. FIGS. 4*a*-4*b* show different perspective views of the closure element 102 including both the first portion 106 and the second portion 108. FIG. 4*a* shows a top perspective view of the closure element 102, and FIG. 4*b* shows a bottom perspective view of the closure element 102.

With simultaneous reference to FIGS. 2, 4*a* and 4*b*, the second portion 108 is configured to cover at least the part of the first portion 106 that is received within the bottle. The second portion 108 thus configured to engage the inside of the bottle neck when the closure element is received within the bottle. More specifically, the second portion 108 forms an outer covering 402 of the fragmented cup structure 302, and furthermore has legs 404 that extend into and fill the axial slots 310. In this embodiment, the legs 404 do not extend inward any further than the inner surface of the spring elements 328. The legs 404 thereby cooperate with the fragmented cup structure 302 to form a more complete cup structure 406, still with a hollow interior.

Referring again to the outer covering 402 of the second portion 108, the outer covering 402 includes an outer surface 408 that defines the outer surface of the closure element 102. The outer surface 408 is substantially cylindrical in this embodiment, but may include one or more protruding features. For example, the outer surface 408 of the present embodiment includes an annular rib 410 or annular bump extending radially from the substantially cylindrical surface. The annular rib 410 in this embodiment is in the form of an annular feature that gently tapers outward to an outer most point, and then gently tapers inward to the cylindrical portion of the outer surface 408. The annular rib 410 is disposed proximate an axial middle of spring elements 328. As such, the force of compression from placing the closure element 102 within the bottle neck is concentrated toward the middle of the spring elements 328, where they are most adapted to flex.

This compression feature, created by the annular protrusion, ridge or rib 410, provides an engineered concentrated annular sealing force, allowing the closure to fit into a wide tolerance range of bottle necks. To this end, mass produced bottles can have significant variation in the "neck" diameter where these closures typically seal. On prior art practice in the design of closures for the industry is to provide the widest possible accommodation of the bore variations thru design and material usage. Typical cork and synthetic closures have a limited sealing range. The embodiment described herein, by the mechanical design and use of different materials as described, allows for a large range of bottle bores to be sealed.

Figure 5:
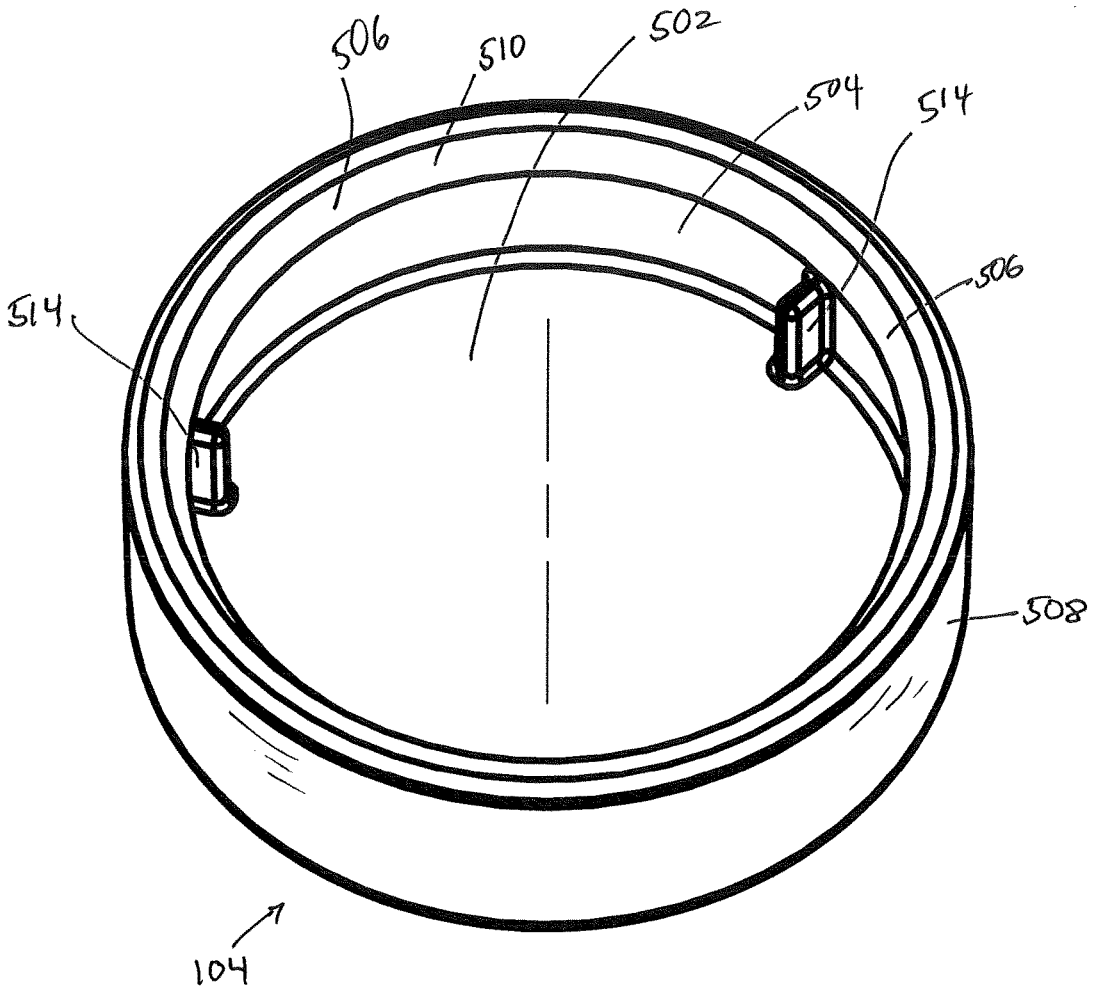
FIG. 5 shows a perspective bottom view of a cap element of the bottle closure FIG. 1.

FIG. 5 shows a perspective view of the cap element 104 apart from the bottle closure 100. Reference is simultaneously made to FIG. 2, which shows the cap element 104 disposed on the closure element 102 in cross-section. The cap element 104 includes a top piece 502, an annular rim 504, an annular locking edge 506, and a gripping surface 508. The top piece 502 in this embodiment is a circular plate that has a diameter that exceeds that of the shelf 312 (and outer edge 318) of the closure element 102. It will be appreciated that the top piece 502 may take other forms, and need not be a circular plate. For example, the top piece 502 may be another shape of plate, or even a hollow or solid three-dimensional ornamental structure.

Regardless of the shape of the top piece 502, however, the annular rim 504 is formed with and extends downward from the top piece 502. The annular rim 504 extends axially to a distance roughly equivalent to the axial extent of the annular ridge 320 of the closure element 102. The annular rim 504 has a diameter that exceeds that of the shelf 312. The annular locking edge 506 is an annular feature that includes a sloped top surface 510 and has a bottom surface 512 (see FIG. 2), that defines an undercut or ledge. In this embodiment, the bottom surface 512 is also sloped, such that the top edge 510 and bottom surface 512 slope toward and meet each other. The bottom surface 512 of the annular locking edge 506 is configured to engage and retain the outer annular edge 318 of the closure element 102. To this end, the innermost edge of the annular locking edge 506 has a diameter that is smaller than the diameter of the outer edge 318 of the head portion 304 of the closure element 102. (See FIG. 2).

The cap element further includes a plurality of vertical ribs 514 disposed on and radially inward from the annular rim 504. The vertical ribs 514 are configured to be received between adjacent detents 322 of the head portion 304 of the first portion 106 of the closure element 102. The vertical ribs 514 and the detents 322 cooperate to inhibit and/or prevent rotation of the cap element 104 with respect to the closure element 102. While vertical/axial ribs 322/514 are employed in this embodiment, it will be appreciated that other mating anti-rotation features may be implemented on the cap element 104 and the head portion 304.

The gripping surface 508 extends in the axial direction and should include opposing surfaces that allow gripping and pulling. The opposing surfaces in the embodiment of FIG. 5 are the diametrically opposed portions of the cylindrical body. Nevertheless, the surface 508 may otherwise take any suitable form, including a generally cylindrical surface or other three-dimension shape, and may have a smooth, ribbed, or other type of surface relief. Any shape with nontrivial axial height will likely provide opposing surfaces sufficient for gripping and pulling.

Thus, the materials and construction of the bottle closure 100 are designed for cost-effectiveness and enhanced utility. To construct the bottle closure 100, the cap element 104 and the closure element 102 are molded separately and then assembled together.

To mold the closure element 102, the first portion 106 is first molded using a suitable fixture to provide the structure discussed above in connection with FIGS. 3*a* and 3*b*. The first material of the first portion 106 may suitably be polypropylene. Thereafter, the molding fixture, not shown, is adjusted to create the negative of the entire closure element 102 while the first portion 106 remains in situ in the fixture. The second material in molten state is then injected into the molding fixture to create the second portion 108. The first portion 106 and second portion 108 bond to each other during the molding process. The second material may suitably be a thermoplastic elastomer. The result of the second shot is the closure element 102 as shown in FIGS. 4*a* and 4*b*.

The cap element 104 is separately molded using conventional means. The cap element 104 is then assembled onto the closure element 102. The assembly initiates by aligning the cap element 104 over the head portion 304 of the closure element 102. In such alignment, the annular rim 504 surrounds the annular ridge 320. The cap element 104 is then pressed downward onto the head portion 304. As a result, the bottom surface 510 of the inner annular edge 506 engages the outer edge 318 of the head portion 304 of the closure element 102. If sufficient force is applied, the collective deformation of the outer edge 318 and inner annular edge 506 allows the outer edge 318 to move past the inner annular edge 318 and snap into place to produce the finished product shown in FIGS. 1 and 2. In the finished bottle closure 100, the upper surface 512 of the inner annular edge 506 abuts the outer edge 318. In other words, the inner annular edge 506 of the cap element 104 and the outer edge 318 of the closure element 102 cooperate to provide a snap fit assembly of the bottle closure 100. In addition, the each of the vertical ribs 514 now is meshed between adjacent detents 322, thereby providing or inhibiting rotation of the cap element 104 with respect to the closure element 102.

One of the advantage of the above-described embodiment is that the closure element 102 has a open interior (i.e. the interior of the cup 406). The bottle closure 100 allows for the open interior by employing a first portion 106 of a harder material, which provides a strong sealing force, and a softer second portion 108 that provides the pliability for facilitating insertion and sealing compliance with various sizes of bottle bores. The snap-fit cap element design allows for a single closure element design to be married to a plurality of differently designed caps, which may take many different ornamental designs, and/or include different product names or other indicia.

In addition, although the structure of the closure 100 is essentially hollow, it can alternatively contain a pressurized gas such as nitrogen to further enhance the dynamics and function of the closure element 102. In any event, the hollow structure allows for significant material reductions in comparison with current competitive products on the market.

It will be appreciated that the above-described embodiments are merely exemplary, and that those of ordinary skill in the art may readily devise their own modifications and implementations that incorporate the principles of the present invention and fall within the spirit and scope thereof.

What is claimed is:

1. A bottle closure comprising:

a closure element configured to be received at least in part within a portion of a bottle, the closure element comprising a first portion of a first material and a second portion of a second material, the second material having a lower durometer hardness than the first material, the second material moldably bonded to the first material, the closure element defining a hollow interior;

the first portion including a plurality of spring elements connected to each other at respective first and second ends thereof; and a cap element coupled to the closure element, wherein the first portion of the closure element comprises a fragmented cup structure having a rounded side structure formed of the plurality of spring elements and a bottom structure, the rounded side structure including a plurality of axial slots formed between adjacent spring elements of the plurality of spring elements, said slots extending partially into the bottom structure, and wherein the first portion of the closure element further comprises a shelf extending radially outward of a top of the fragmented cup structure, the shelf configured to engage and retain the cap element, the cap element fixed relative to the closure element in an axial direction.

2. The bottle closure of claim 1, wherein the rounded side structure has a frustoconical shape.

3. The bottle closure of claim 2, wherein the second portion forms an outer surface of the closure element and includes at least one annular rib extending radially therefrom.

4. The bottle closure of claim 1, further comprising a ridge extending axially upward from the shelf, and a plurality of detents disposed on an outer surface of the ridge, and above the shelf; and wherein the cap element includes at least on corresponding detent disposed at least in part between two of the plurality of detents on the outer surface of the ridge.

5. The bottle closure of claim 1, wherein the second portion is configured to cover at least a part of the first portion, the second portion configured to engage the bottle when the closure element is received within the bottle.

6. A bottle closure comprising:

a closure element configured to be received at least in part within a portion of a bottle, the closure element comprising a cup structure having an open end and a closed end, the cup structure comprising a first material and a second material, the second material having a lower durometer hardness than the first material, the second material moldably bonded to the first material, the cup structure defining a hollow interior; and a cap element coupled proximate to the open end of the cup structure of the closure element without extending into the hollow interior defined by the cup structure.

7. The bottle closure of claim 6, wherein the second material defines at least a part of an outer surface of the cup structure.

8. The bottle closure of claim 7, wherein the cup structure includes spring elements formed of the first material.

9. The bottle closure of claim 8, wherein the spring elements extend from a top of the cup to a bottom of the cup structure, and wherein the second material is disposed between adjacent spring elements.

10. The bottle closure of claim 8, wherein the second material is a thermoplastic elastomer.

11. The bottle closure of claim 10, wherein the first material is polypropylene.

12. The bottle closure of claim 8, wherein the spring elements collectively form a partial frustum.

13. The bottle closure of claim 8, wherein the outer surface is substantially cylindrical and further includes at least one annular rib extending radially therefrom.

14. The bottle closure of claim 13, wherein the at least one annular rib is disposed proximate an axial middle of spring elements.

15. The bottle closure of claim 6, wherein the closure element further includes a shelf extending from proximate a top of the cup structure, the shelf configured to engage and retain the cap element.

16. The bottle closure of claim 15, wherein the cap element snap fits onto the shelf and is fixedly connected to the closure element in an axial direction.

17. The bottle closure of claim 6, wherein closure element further includes a head portion formed at a top of the cup structure.

18. The bottle closure of claim 17, wherein the head portion further includes a shelf extending from proximate a top of the cup structure, the shelf configured to engage and retain the cap element.

19. A bottle closure comprising:

a closure element configured to be received at least in part within a portion of a bottle, the closure element comprising a first portion of a first material and a second portion of a second material, the second material having a lower durometer hardness than the first material, the second material moldably bonded to the first material, the closure element defining a hollow interior; and a cap element coupled to the closure element and fixed relative to the closure element in an axial direction;

wherein the first portion of the closure element comprises a fragmented cup structure having a rounded side structure and a bottom structure, the rounded side structure including a plurality of axial slots formed therein, said slots extending partially into the bottom structure, and wherein an interior surface of the fragmented cup structure defines the hollow interior and is free from engagement with any surface of the cap element.

* * * * *